United States Patent [19]

Bavnsfelt

[11] 4,415,094

[45] Nov. 15, 1983

[54] SAFETY CAP

[75] Inventor: Hans Bavnsfelt, Copenhagen, Denmark

[73] Assignee: Mogens Rued Nielsen ApS, Tappernoje, Denmark

[21] Appl. No.: 338,525

[22] Filed: Jan. 11, 1982

[30] Foreign Application Priority Data

Jan. 27, 1981 [DK] Denmark ..... 354/81

[51] Int. Cl.[3] ..... B65D 41/34

[52] U.S. Cl. ..... 215/252

[58] Field of Search ..... 215/250, 251, 252

[56] References Cited

U.S. PATENT DOCUMENTS 2,153,427 4/1939 Fleisch et al. ..... 215/252

4,196,818 4/1980 Brownbill ..... 215/252

4,310,102 1/1982 Walter ..... 215/250 X

FOREIGN PATENT DOCUMENTS 716100 10/1966 Italy ..... 215/252

*Primary Examiner*—Donald F. Norton

*Attorney, Agent, or Firm*—Mason, Fenwick & Lawrence

[57] ABSTRACT

In a safety cap of the kind consisting of a base out of soft material intended to be mounted on the mouth of a bottle, and a closure intended to be screwed on the base, there is a sealing ring (5 and 12) at the bottom of both the closure and the base. The sealing rings (5 and 12) are designed in such a way that they are not removable after fracture of the closures. Thus, the user will be completely sure that the contents of the bottle are those expected, as it is easy for the user to ascertain whether the bottle was opened.

7 Claims, 6 Drawing Figures

SAFETY CAP

The invention is related to a safety cap preferably out of plastics and of the kind consisting of two parts, i.e. a base subassembly intended for mounting on the mouth of a container and a closure subassembly intended for mounting on the base subassembly.

Such caps were for instance used for containers or bottles for eye drops. Thus, it is of the utmost importance that one feels sure of the contents when starting using the bottle.

Thus, the object of the present invention is to provide a two part security cap of the kind which is closed continuously from the place of filling of the container which it is designed to protect to delivery of the same to the user, so that the user can readily discover if any attempt has been made to open the cap which could signify that the contents have been contaminated or are not as expected.

The security cap according to the invention is formed as a two part cap having a base subassembly and a closure subassembly, the bottom of both the base subassembly and closure subassembly each are connected by means of bridge pieces to a one sealing ring each to the effect that in mounting the closure on the base subassembly the closure is permanently registered with the base subassembly and consequently the bridges will fracture when the closure is detached from the base subassembly, and to the effect that in putting the base subassembly on a container, the sealing ring of the base subassembly is permanently registered with a protruding bulge on the containers thus causing fracture of the bridges when the base subassembly is detached from the container. By a glance on the bridges it is easy to ascertain whether the cap was opened.

In accordance with the invention a screw thread is provided in each part, the closure achieved will be more reliable, and at the same time more strength will be available for breaking the bridges which could be made more secure to the effect that they are not breaking prematurely, e.g. during production.

Figure 1:
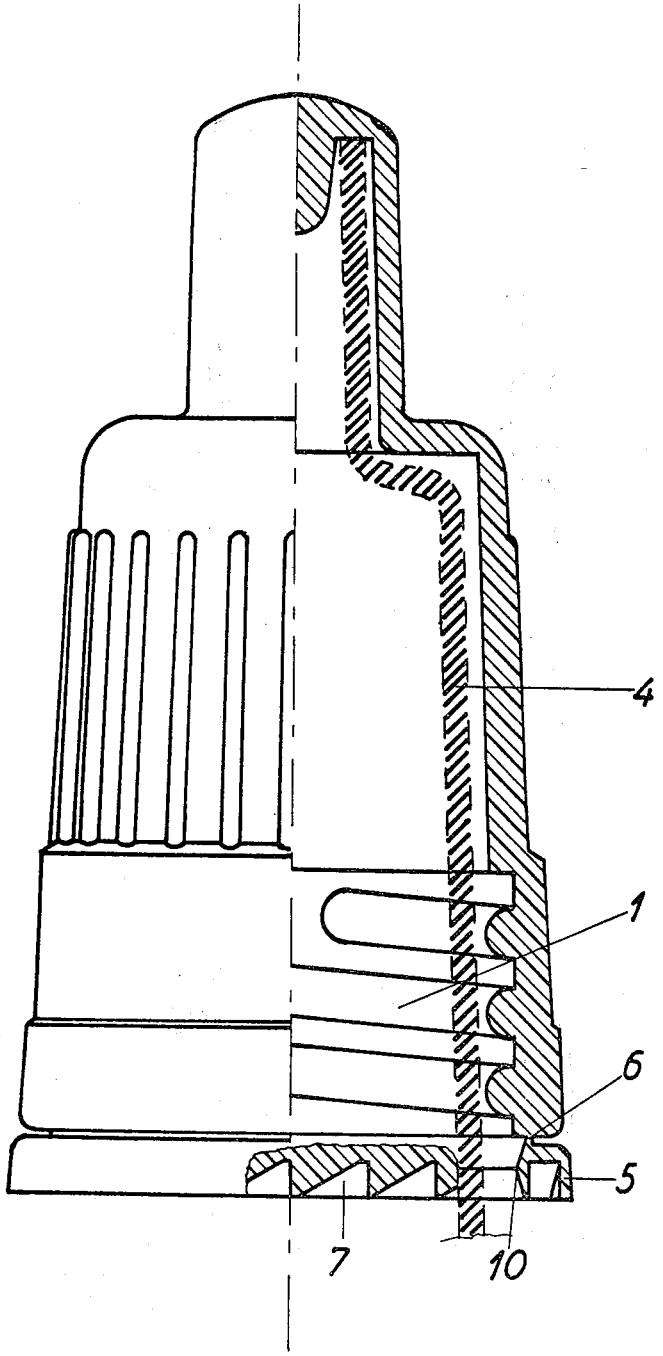
Figure 2:
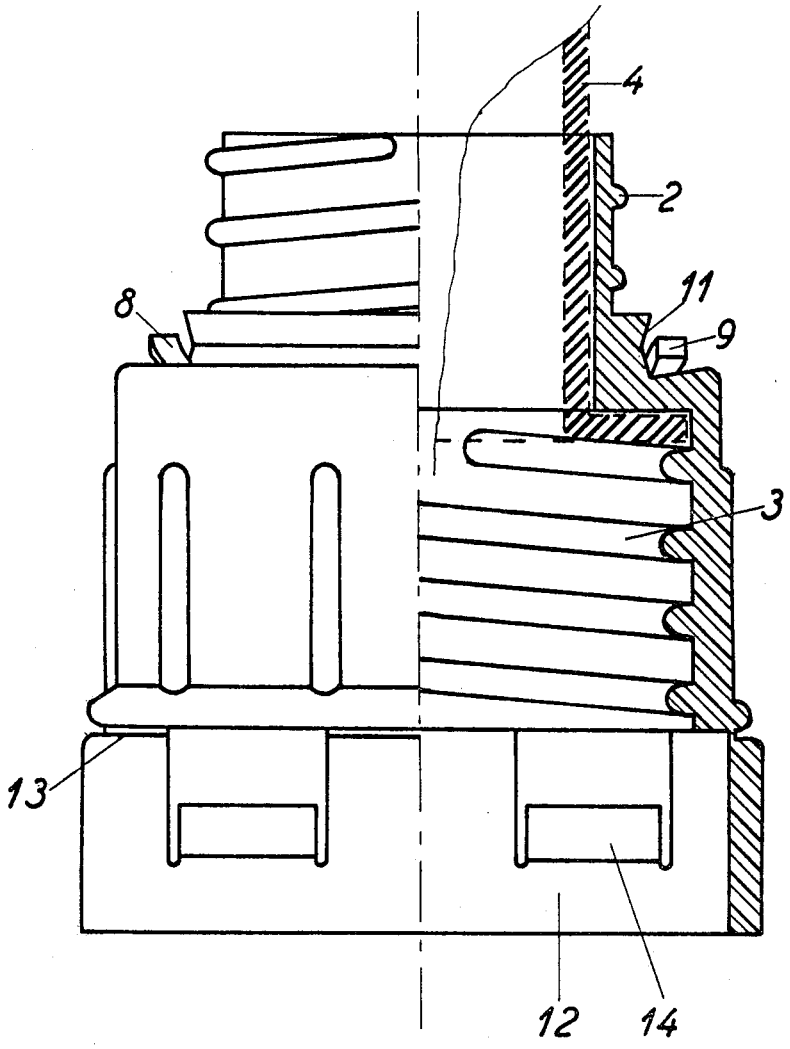
Figure 3:
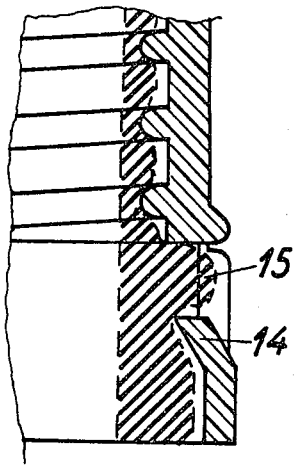
Figure 4:
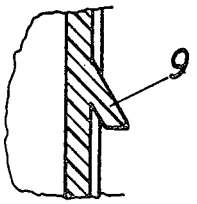
Figure 5:
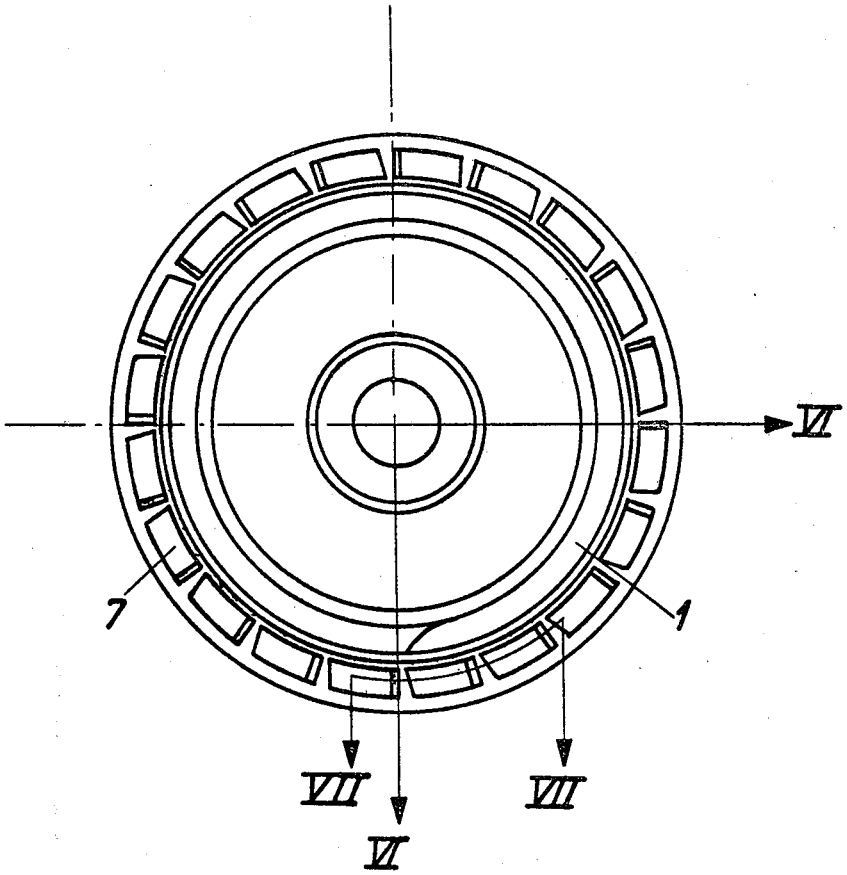
Figure 6:
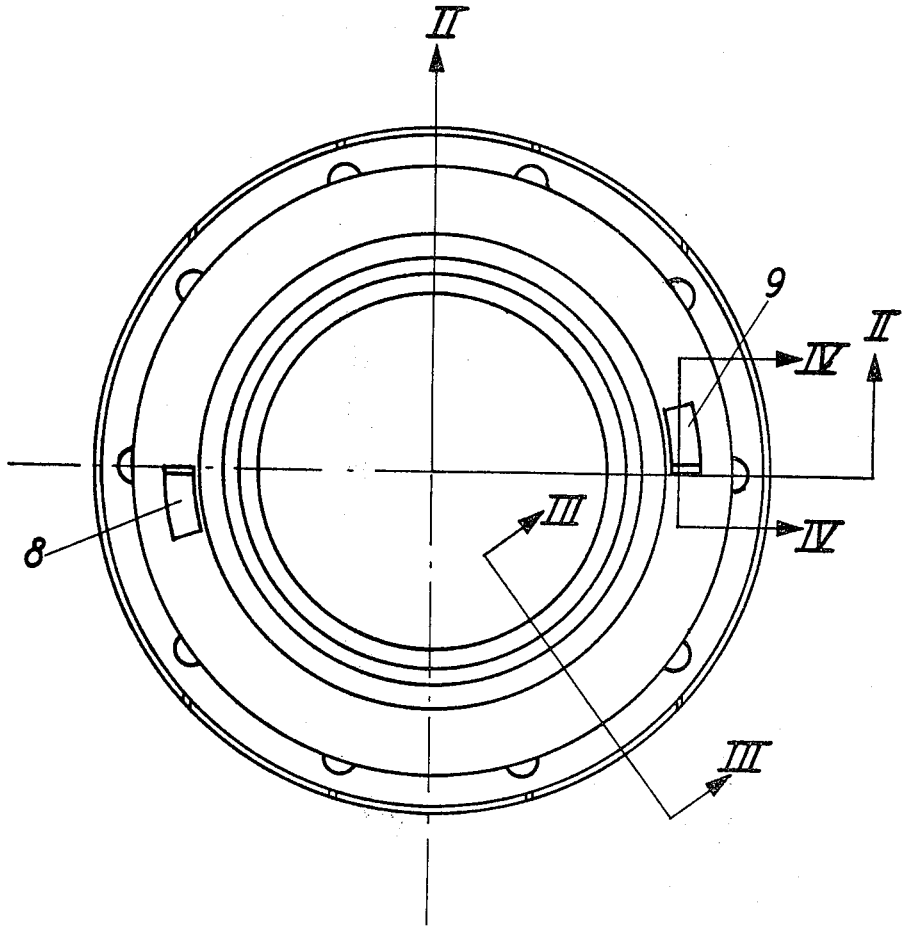

The drawing of a preferred embodiment of the safety cap according to the invention is showing, FIG. 1 a sideview of a closure partly in section, FIG. 2 a sideview of a base subassembly partly in section, FIG. 3 a section along the line III—III of FIG. 6, FIG. 4 a section along the line IV—IV of FIG. 6, FIG. 5 the closure seen from the bottom, and FIG. 6 the base subassembly seen from above In FIG. 1 is shown a closure in the form of a screw cap intended for screwing on a base subassembly as shown in FIG. 2, the corresponding closure having an interior screw thread 1 and the base subassembly having a corresonding exterior screw thread 2. By means of an interior screw thread 3 the base subassembly is screwed on the mouth of a bottle not shown. In the base subassembly a known pipette part 4 out of soft material, e.g. rubber, is arranged. At the bottom of the closure a sealing ring 5 is arranged, and the two parts are interconnected by one or several thin bridges frangible 6. On the underside of the sealing or security ring 5 jags or sawtooth shoulder formations 7 are arranged obliquely for registering with barbs or tooth formations 8 and 9, see FIGS. 2, 4, and 6, thus impeding rotation if detachment of the closure from the base subassembly is attempted. Further, the sealing ring 5 includes a conical or wedgeshaped section 10 on the side turning radially inwards, and in the contact face the section 11 of the base subassembly is corresponding. Due to the design it is extremely difficult to remove the sealing ring 5 after opening which provides evidence of opening when the frangible bridges 6 connecting the sealing ring 5 with the associated part of the base subassembly have been broken.

A sealing or security ring 12 is arranged on the base subassembly, and likewise the parts are interconnected by one or several bridges 13. Along the periphery of the sealing ring 12 a plurality of inwards projecting barbs 14 are arranged intended to register with a protruding container bulge 15, as indicated in FIG. 3, in such a way that it is possible to pass the sealing ring donwards over the bulge 15 whereas it is impossible—or at least very difficult—to pull it upwards once the barbs 14 register with the buldge 15. Thus, it is in a similar way possible to ascertain that the base subassembly was detached from the container.

FIGS. 3 and 4 which were already described show sections as indicated in FIGS. 5 and 6.

FIG. 5 shows the closure seen from the bottom, whereas FIG. 6 shows the base subassembly seen from above. Reference numbers are those previously applied.

I claim:

1. A two part security cap of plastic or like material adapted to be mounted on a mouth of a container and constructed to provide indication of unauthorized opening, the two part security cap including a base subassembly to be mounted on the mouth of the container and a closure subassembly for mounting on the base subassembly respectively comprising a base collar member and a closure cap member each having a security ring at the bottom thereof connected to the associated base collar member and closure cap member by thin frangible bridges, the security ring of the closure subassembly and the base collar member of the base subassembly having interengaging formations restraining the same against relative movement whereby the frangible bridges interconnecting said security ring with its associated closure cap member are caused to fracture when the closure subassembly is removed from the base subassembly, and the security ring of the base subassembly having means securing the same against rotation on the mouth of the container whereby forced removal of the base subassembly from the container produced fracture of the frangible bridges associated with the last mentioned security ring.

2. A safety cap as defined in claim 1, wherein said base collar member and said closure cap member include complementary screw threads coactive with each other for threading the closure subassembly onto the base subassembly.

3. A safety cap as defined in claim 2, wherein the means interconnecting the security ring of said closure subassembly to the base collar member of said base subassembly include sawtooth shoulder formations on said security ring interengaging barb-like tooth formations on said base collar member and means in restraining engagement with each other for preventing relative rotation of the closure subassembly on the base subassembly in a direction to decouple such subassemblies from each other.

4. A safety cap as defined in claim 2, wherein said container includes a protruding bulge formation, and said security ring of the base subassembly having a plurality of inwardly directed barb formations to engage the container bulge formation upon assembly on the container and secure said last mentioned security ring against relative rotation on or removal from the container.

5. A safety cap as defined in claim 1, wherein the means interconnecting the security ring of said closure subassembly to the base collar member of said base subassembly include saw-tooth shoulder formations on said security ring interengaging barb-like tooth formations on said base collar member and means in restraining engagement with each other for preventing relative rotation of the closure subassembly on the base subassembly in a direction to decouple such subassemblies from each other.

6. A safety cap as defined in claim 5, wherein said container includes a protruding bulge formation, and said security ring of the base subassembly having a plurality of inwardly directed barb formations to engage the container bulge formation upon assembly on the container and secure said last mentioned security ring against relative rotation on or removal from the container.

7. A safety cap as defined in claim 1, wherein said container includes a protruding bulge formation, and said security ring of the base subassembly having a plurality of inwardly directed barb formations to engage the container bulge formation upon assembly on the container and secure said last mentioned security ring against relative rotation on or removal from the container.

* * * * *